United States Patent [19]

Yamada et al.

[11] 4,304,157

[45] Dec. 8, 1981

[54] TORQUE WRENCH

[76] Inventors: Keiichi Yamada, 20-19, 4-chome, Hancho Minoh-Shi, Osaka Prefecture; Kanzi Miyatake, 7-4, 2-chome, Honanchonishi, Toyonaka-Shi, Osaka Prefecture, both of Japan

[21] Appl. No.: 134,138

[22] Filed: Mar. 26, 1980

[30] Foreign Application Priority Data

Feb. 1, 1980 [JP] Japan ..... 55-12363[U]

[51] Int. Cl.[3] ..... B25B 13/46

[52] U.S. Cl. ..... 81/57.39; 81/57.3; 74/125

[58] Field of Search ..... 81/57.39, 57.3; 74/112, 74/116, 122, 125

[56] References Cited

U.S. PATENT DOCUMENTS

| | | | |
|---|---|---|---|
| 2,723,580 | 11/1955 | Brame | 81/57.39 |
| 3,270,595 | 9/1966 | Hall et al. | 81/57.39 |
| 3,270,596 | 9/1966 | Hall et al. | 81/57.39 |

*Primary Examiner*—James L. Jones, Jr.

*Attorney, Agent, or Firm*—Wenderoth, Lind & Ponack

[57] ABSTRACT

The main body of a wrench has incorporated in its hollow interior an eccentric ring for receiving input, a ratchet wheel for giving output, pushing bars disposed between the eccentric ring and the ratchet wheel and linearly movable by the rotation of the eccentric ring, and pawls for intermittently rotating the ratchet wheel in one direction every time when the pawls are pushed by the forward ends of the bars. The main body is externally provided with a reaction withstanding lever forced outward at all times by a spring-loaded cam and a lever for freeing the lever from the force of the cam.

2 Claims, 4 Drawing Figures

21
22
17
17a
20
16
18
3b
3c
A
A
3
12
3a
8
2
7
1
23
11
2a
16a
7a
10
9
5a
5b
5c
6
14
5

21
23
3c
3c
20
17
19
2
18
16
2
1
16a
5c
1c
1b
1a

TORQUE WRENCH

BACKGROUND OF THE INVENTION

The present invention relates to an improved torque wrench which is adapted to transmit the rotation of an input shaft to an output shaft by a ratchet wheel rotatable by the crank motion of an eccentric ring and by which bolts, nuts and the like can be fastened or loosened easily and rapidly in a limited space without the necessity of moving the main body of the wrench.

Conventional torque wrenches of this type comprise two sprocket wheels for an input shaft and an output shaft and an endless chain reeved around the sprocket wheels for transmitting the rotation of the input shaft to the output shaft. We have already provided such a torque wrench. The known devices nevertheless have the following drawbacks. The chain power transmission system involves difficulties in giving a high power transmission ratio or affording output at an altered transmission ratio because of various limitations. Additionally the chain is unable to transmit the torque reliably and efficiently because the elongation or play involved in the chain tends to become progressively pronounced. Further when the input member is driven as by a motor, the wrench is likely to stop its operation with the rear end of the main body forcibly pressed against an obstacle or wall by a reaction upon completion of a nut fastening operation. The main body is then difficult to release, and a serious trouble could result.

SUMMARY OF THE INVENTION

An object of this invention is to provide an improved torque wrench which is adapted to effectively transmit the rotation of an input shaft to an output shaft via pushing bars movable by the crank motion of an eccentric ring and further via a ratchet wheel rotatable by the pushing bars and by which bolts, nuts and the like can be fastened or loosened easily, rapidly and reliably in a limited space with the main body of the wrench held in its fixed position.

Another object of the invention is to provide a reaction withstanding mechanism for the torque wrench which mechanism comprises a reaction withstanding lever provided on the main body of the wrench, a cam for biasing the lever outward and a release lever for freeing the lever from the action of the cam, such that when the main body has become unremovable by being forcibly pressed as against an obstacle by the reaction, for example, of a fastening force, the wrench can be released from the obstacle with ease and safety by a single action of the release lever.

Another object of the invention is to provide a torque wrench of the type described above which is usable as a usual wrench when the eccentric ring is not used for receiving input, such that since the eccentric ring then will not idly rotate, a bolt or the like can be fastened or loosened easily by the ratchet wheel which is rotatable in only one direction.

DESCRIPTION OF THE PREFERRED EMBODIMENT

Figure 1:
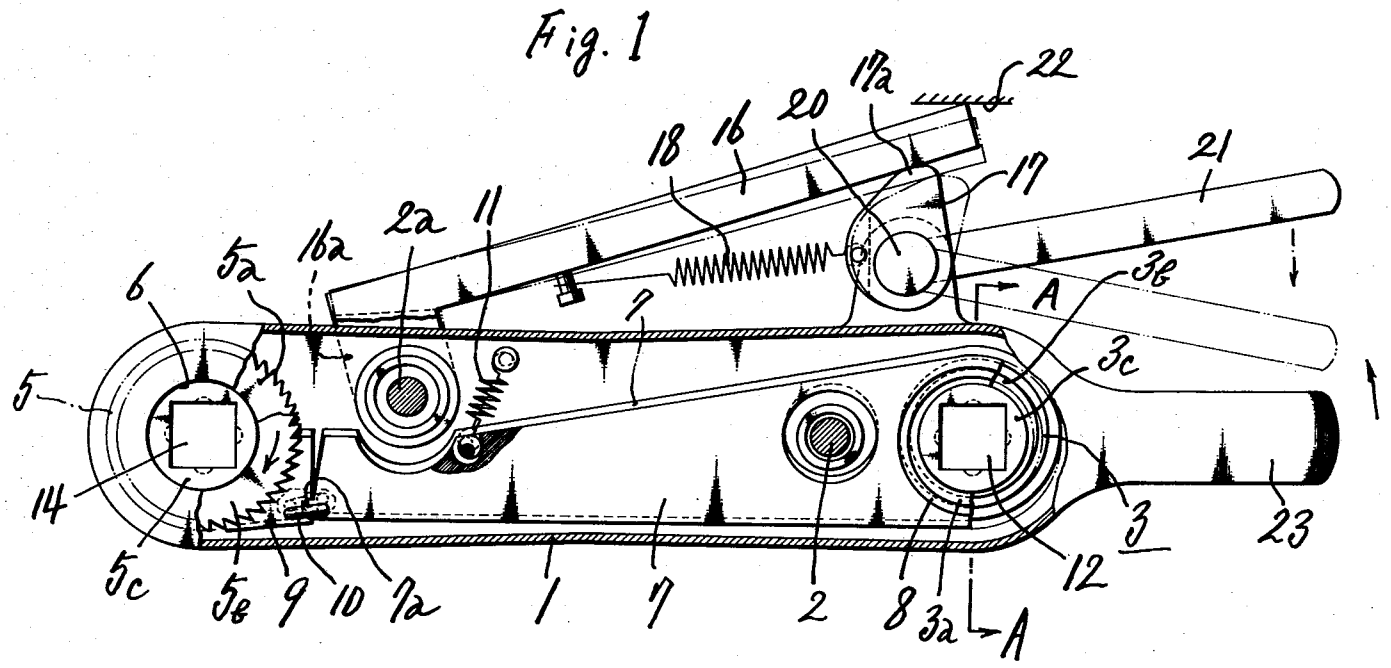
FIG. 1 is a plan view partialy in section and showing a torque wrench according to this invention.
Figure 2:
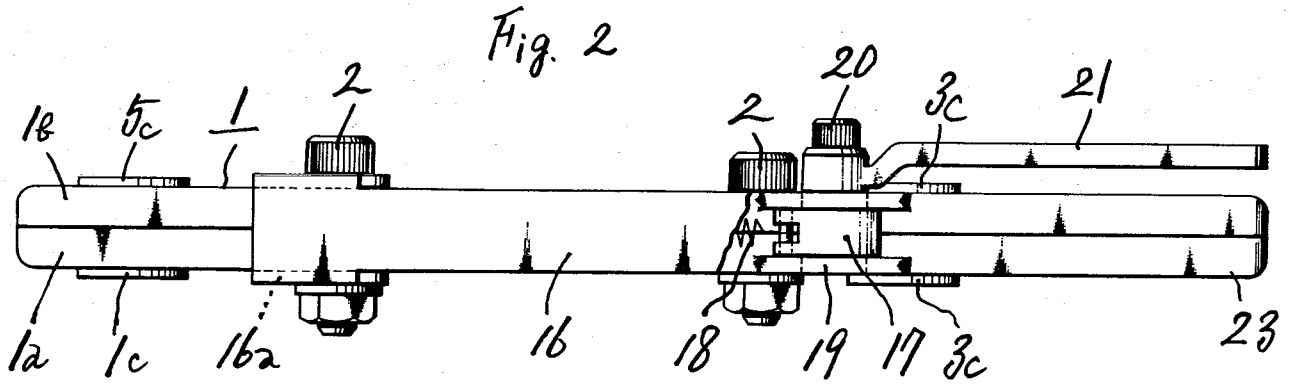
FIG. 2 is a side elevation showing the torque wrench.
Figure 3:
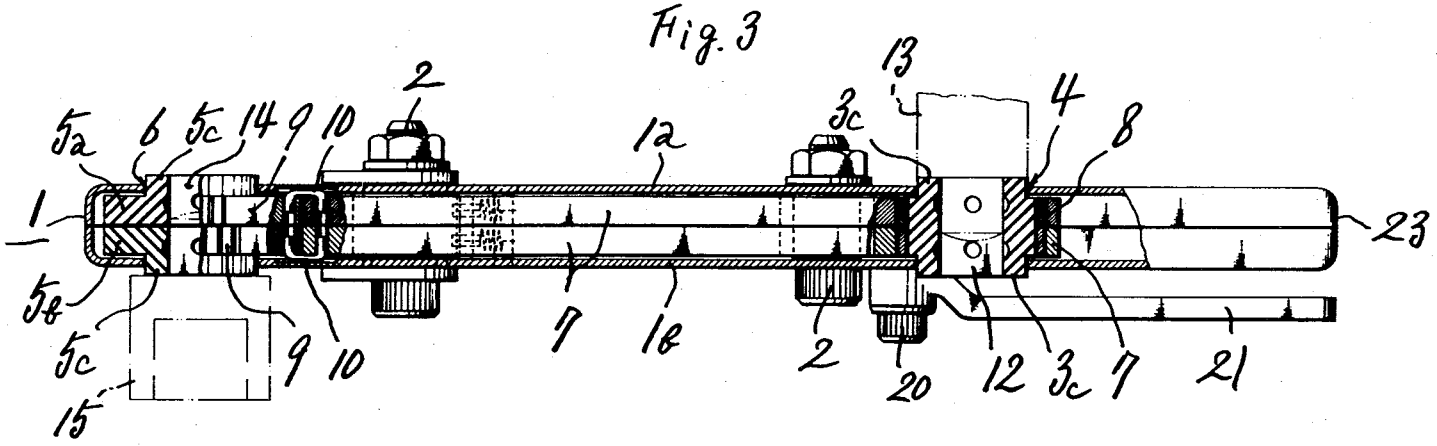
FIG. 3 is a side elevation partly in section and showing the torque wrench as it is seen from the opposite side to FIG. 2.
Figure 4:
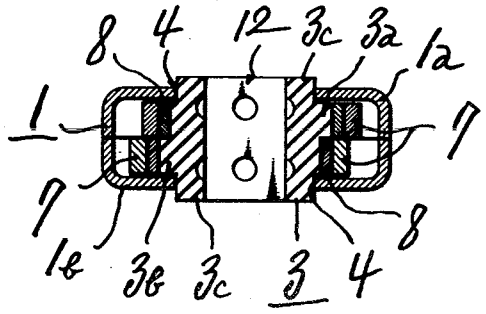
FIG. 4 is an enlarged view in section taken along the line I—I in FIG. 1.

With reference to FIGS. 1 and 2, a wrench main body 1 is in the form of an elongated closed case and made up of two channel-shaped segments 1*a* and 1*b* joined together with screws 2 as opposed to each other. The main body has a hollow interior portion. A double eccentric ring 3 supported by the main body 1 at its one end comprises eccentric segments 3*a* and 3*b* each projecting in one direction opposite to the other and has a boss 3*c* on either side. The bosses 3*c* are fitted in circular holes 4 formed in the main body 1 at its opposite sides, whereby the eccentric ring 3 is made freely rotatable within the hollow interior of the body 1. A double ratchet wheel 5 supported by the main body 1 at the other end thereof comprises segments 5*a* and 5*b* with their teeth displaced from each other by a half pitch. The wheel 5 has on its opposite sides bosses 5*c* fitted in circular holes 6 in the main body and is thereby made freely rotatable in the hollow interior. Two pushing bars 7 have at their rear ends outer rings 8 fitted to the eccentric ring 3 for a crank motion. The pushing bars 7 are provided at their forward ends with pawls 9 in engagement with the ratchet wheel segments 5*a* and 5*b*, respectively, to intermittently rotate the segments 5*a* and 5*b* every time the bars 7 are advanced to push the pawls 9. The pawl 9 is formed in its lower rear end with a recess in which a projection 7*a* on the forward end of the bar 7 engages to pivotally movably support the pawl 9 like a fulcrum for a lever. The bar 7 and the pawl 9 are connected together by a pin 10 against separation. A tension spring 11 for the bar 7 biases the forward end (free end) of the bar 7 upward in FIG. 1, thereby holding the pawl 9 in contact with the corresponding ratchet wheel segment at all times against disengagement.

The eccentric ring 3 has a square bore 12 extending transversely therethrough. The operating shaft 13 of a ratchet handle or of an impact wrench operable by a motor or pneumatically is inserted into the bore 12 to drive the eccentric ring 3 manually or by power. The ratchet wheel 5 is provided with a similar square bore 14 or with a square projection, to which a socket 14 for turning a bolt or nut is fitted. The ratchet wheel 5, when driven, turns the bolt or nut with the socket 15.

The main body 1 is externally provided with a reaction withstanding lever 16 having a bifurcated forward end 16*a* turnably supported by a pivot 2*a* and a free end (rear end) bearing on a cam 17. The cam 17 is biased by a spring 18 to force the free end outward at all times. The cam 17 is turnably supported by a pivot 20 on a bracket 19 projecting from one side of the main body 1 and is turnable by a release lever 21 extending therefrom rearward. The release lever 21 extends approximately in parallel to a handle 23 projecting from the rear end of the main body 1. When the lever 21 is to be operated, both the lever 21 and the handle 23 are gripped at the same time. While the lever 21 is in a free state out of operation, the cam 17 has its projection 17*a* directed upward in FIG. 1 by the action of the spring 18, with the lever 16 bearing against the top of the projection 17*a* under the action of the same spring 18. The cam 17 in this position provides a dead point relative to the load acting on its projection and is not free to incline from this position unless moved by the release lever 21.

When the eccentric ring 3 of the above arrangement is rotated as by a ratchet handle, the two pushing bars 7 advance alternately every time the ring makes one turn, causing the two pawls 9 to rotate the ratchet wheel 5 intermittently by an amount at a time. Since the two ratchet wheel segments 5*a* and 5*b* are displaced from each other by a half pitch of their teeth, they are advanced in succession without any interruption by the two pushing bars 7 one of which is advanced while the other is retracted.

When a nut or the like is forcibly fastened by an impact wrench, the main body 1 will be turned counterclockwise in FIG. 1 (indicated by an arrow) about the ratchet wheel 5 at the front end by the reaction acting on completion of the fastening operation, forcing the reaction withstanding lever 16 into contact with a wall 22 or the like. In such an event, the rear end of the main body would be held in direct pressing contact with the wall if the wrench is not provided with the reaction withstanding means comprising the lever 16 and cam 17, with the result that the wrench would not be easily removable after the completion of the work. According to this invention, however, the release lever 21, when moved toward the handle 23, turns the cam 17 from the dead point position to release the lever 16 and forms a space between the wall 22 and the lever 16. The wrench is therefore easily removable.

When a ratchet handle or power-driven impact wrench is not used for the input member, the handle 23 may be moved reciprocally back and forth with a nut or the like fitted in the square bore 14 or socket 15 at the output end. When the handle 23 is turned about the ratchet wheel 5 clockwise in FIG. 1, the ratchet wheel 5 and the eccentric ring 3 are connected together by the pushing bars 7 to act as a rigid body, whereas when the handle is turned in the reverse direction, the pawls 9 idly slide along the ratchet wheel 5 in a fixed position, so that the wrench can be operated continuously.

Since the device of this invention has the construction described above, the power from the input element can be effectively delivered to the output element via the pushing bars which are brought into a crank motion by the eccentric ring, and the device is smoothly operable free of the play or backlash involved in chain transmission. Moreover the torque wrench itself is usable as a usual wrench. The torque transmission ratio is variable easily by replacing the ratchet wheel only. Further even if the free end of the main body should be forcibly held in pressing contact with an obstacle by a reaction, the wrench is easily and effectively removable by a single action of the release lever. Since the cam and the reaction withstanding lever are biased outward by a spring at all times, the wrench is readily usable without any preparatory procedure.

The present device has other advantages; it is compact and light in its entirety, simple and durable in construction and inexpensive to manufacture.

The present invention is not limited to the embodiment described above but can be modified within the concept and scope of the invention as defined in the appended claims.

What is claimed is:

1. A torque wrench comprising a main body having a hollow interior, a double eccentric ring disposed in the hollow interior at one end of the main body and composed of two segments each projecting in one direction opposite to the other, a double ratchet wheel disposed in the hollow interior at the other end of the main body and composed of two segments with their teeth displaced from each other, the ring and the ratchet wheel being rotatably supported by the main body, two pushing bars provided between the eccentric ring and the ratchet wheel and each having one end loosely fitting around the corresponding eccentric ring segment and movable straight by the rotation of the eccentric ring to advance while the other pushing bar retracts, and two pawls each provided at the forward end of each of the pushing bars for intermittently rotating the corresponding ratchet wheel segment in one direction every time when pushed by the pushing bar, whereby the ratchet wheel segments are alternately rotated intermittently by a half pitch of the teeth at a time by the pushing bars through the pawls.

2. A torque wrench as defined in claim 1 wherein the main body is externally provided with a reaction withstanding lever turnable about a pivot, a cam for forcing the lever outward at all times by the action of a spring to tiltably support the lever, and an operating lever.

* * * * *